US006634957B2

(12) United States Patent
Tseng

(10) Patent No.: US 6,634,957 B2
(45) Date of Patent: Oct. 21, 2003

(54) GOLF CLUB WITH A WEIGHT MEMBER

(76) Inventor: Wen-Cheng Tseng, No. 27, Kung Chuan Rd., Tai-Shan Hsiang, Taipei Hsien (TW)

( * ) Notice: Subject to any disclaimer, the term of this patent is extended or adjusted under 35 U.S.C. 154(b) by 0 days.

(21) Appl. No.: 10/010,205

(22) Filed: Dec. 6, 2001

(65) Prior Publication Data

US 2002/0151378 A1 Oct. 17, 2002

(30) Foreign Application Priority Data

Apr. 12, 2001 (TW) ..... 090205703

(51) Int. Cl.[7] ..... A63B 53/02
(52) U.S. Cl. ..... 473/306
(58) Field of Search ..... 473/305–312, 473/239, 296, 288, 295, 298, 299, 245, 246, 247, 248; 403/296, 305, 370

(56) References Cited

U.S. PATENT DOCUMENTS 3,825,991 A * 7/1974 Cornell ..... 29/412
5,513,844 A * 5/1996 Ashcraft et al. ..... 473/288
5,586,944 A * 12/1996 Nagamoto et al. ..... 473/248
5,951,411 A * 9/1999 Wood et al. ..... 473/307
6,447,404 B1 * 9/2002 Wilbur ..... 473/296

FOREIGN PATENT DOCUMENTS

AU 15695/28 * 9/1928

* cited by examiner

*Primary Examiner*—Stephen Blau
(74) *Attorney, Agent, or Firm*—Alan D. Kamrath; Rider Bennett LLP

(57) ABSTRACT

A golf club has a weight member provided between a shaft and a head thereof. The weight member is optionally made of materials with high density, and has a weight substantially equal to a weight of a standard head of a conventional golf club minus the weight of the head of the golf club of the invention. Thus, the weight of the head is less than the standard head of the conventional golf club and the whole weight of the golf club is equal to the conventional golf club, so that the twisting force applied to the head of the golf club is lessened, and the stability of the golf club is improved.

5 Claims, 4 Drawing Sheets

GOLF CLUB WITH A WEIGHT MEMBER

BACKGROUND OF THE INVENTION

1. Field of the Invention

The present invention relates to a golf club having a weight member provided between a head and a shaft thereof so as to lessen the twisting force of the head of the golf club when a player is playing golf.

2. Description of Related Art

Conventionally, a golf club generally comprises a shaft, a head and a grip. When playing, the grip of the golf club must be held properly, and the correct posture assumed to strike the ball. Then, the ball is struck and travels away from the tee.

However, due to the irregular configuration, the high density and the weight of the head and the long length of the club, when the head of the golf club is moving at a very high speed from above a player's head to near the player's feet, a twisting force must be applied on the head of the golf club. This force may cause the head portion of the golf club to be twisted, so that the actual striking point must be deviated from the preliminary striking point, which may cause the ball to fly in an undesired direction. It can be appreciated that the stability of the golf club is affected by the twisting force caused on the head of the golf club.

Therefore, it is an objective of the invention to provide a golf club with a weight member provided between the shaft and the head to reduce the twisting force applied on the head so as to improve the stability of the golf club.

SUMMARY OF THE INVENTION

The main object of the present invention is to provide a golf club having a weight member provided between a head and a shaft thereof. The weight member is optionally made of materials with high density and has a weight substantially equal to the weight of a standard head of a conventional golf club minus the weight of the head of the golf club of the invention. Thus, the weight of the head is less than the standard head of the conventional golf club, and the whole weight of the golf club is equal to the standard conventional golf club. As a result, the twisting force applied on the head of the golf club is thus lessened. Therefore, the stability of the golf club is improved.

Other objects, advantages and novel features of the invention will become more apparent from the following detailed description when taken in conjunction with the accompanying drawings.

DETAILED DESCRIPTION OF THE PREFERRED EMBODIMENT

Figure 1:
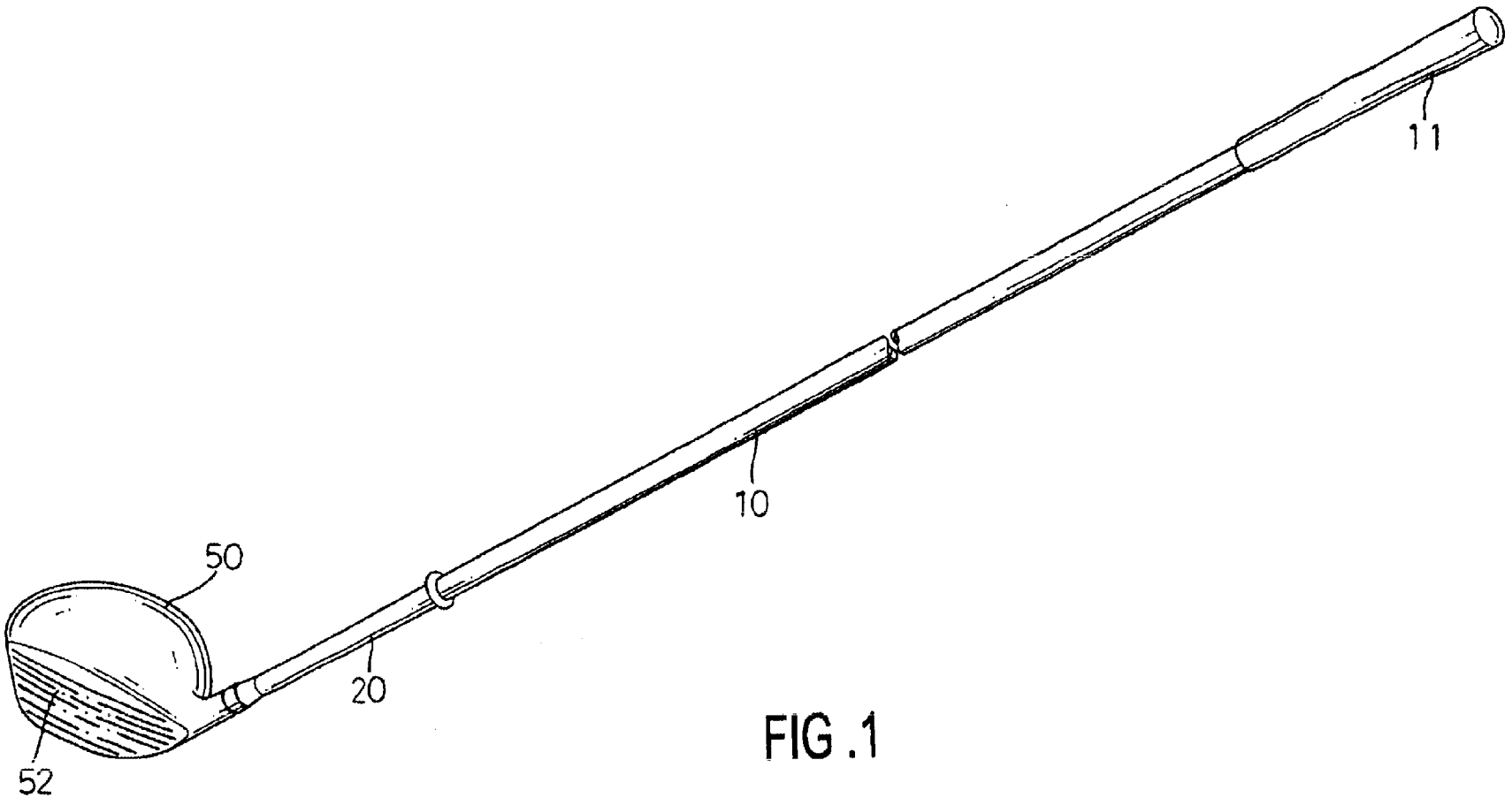
FIG. 1 is a perspective view of a golf club in accordance with the invention.

As shown in FIG. 1, a golf club in accordance with the invention comprises a shaft (10), a grip (11), a head (50), and a weight tube (20) provided between a lower end of the shaft

(10) and the head (50). Particularly, the weight tube (20) has a weight equal to a weight of a standard head of a conventional golf club minus the weight of the head (50) of the golf club of the present invention.

Figure 2:
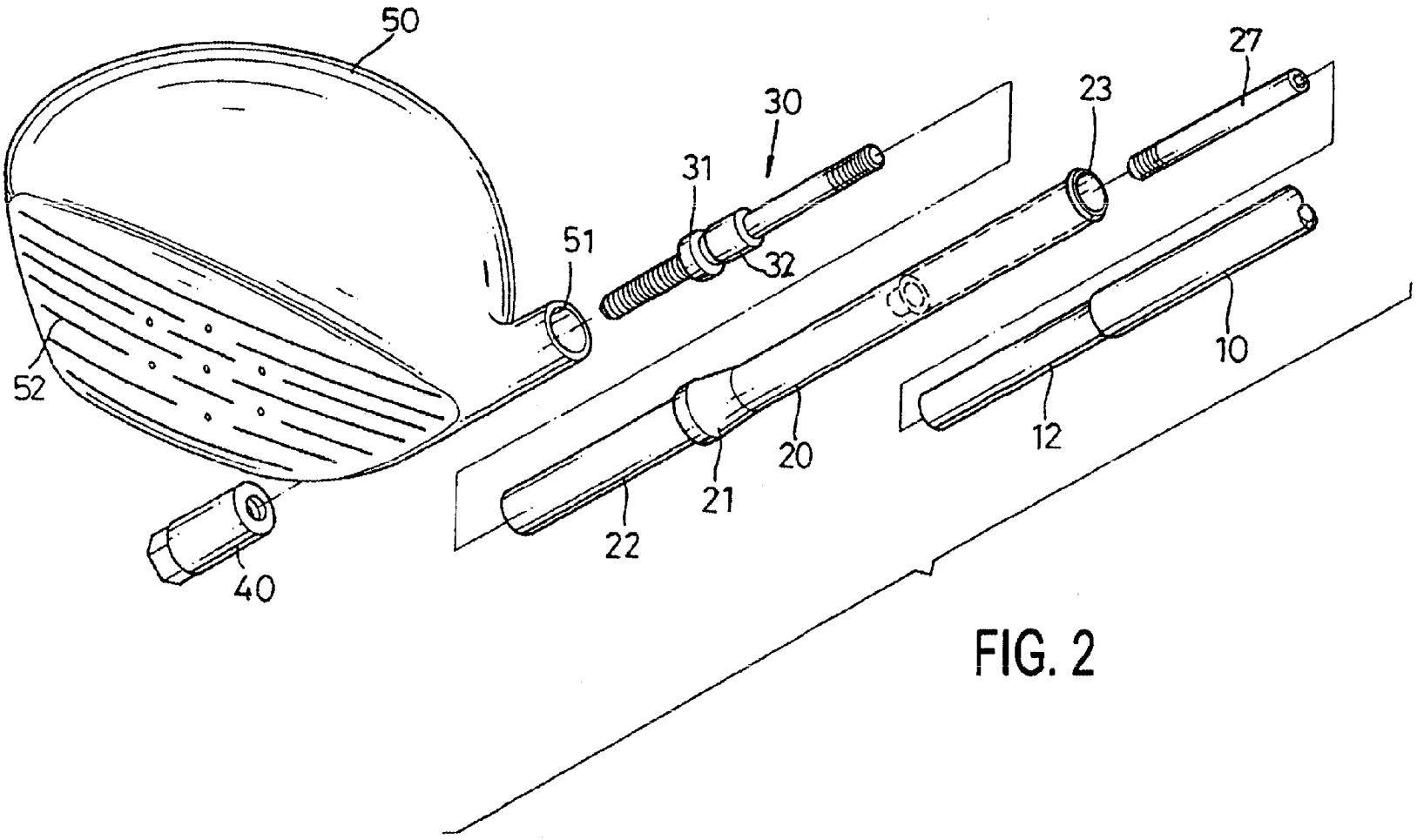
FIG. 2 is an exploded perspective view of the golf club in accordance with the invention.
Figure 3:
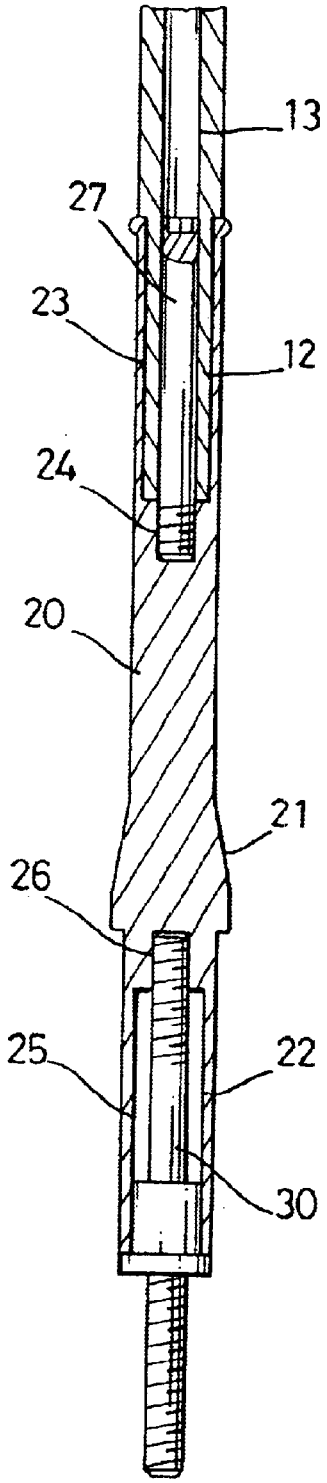
FIG. 3 is a cross sectional view of a weight member of the golf club in accordance with the invention.
Figure 4:
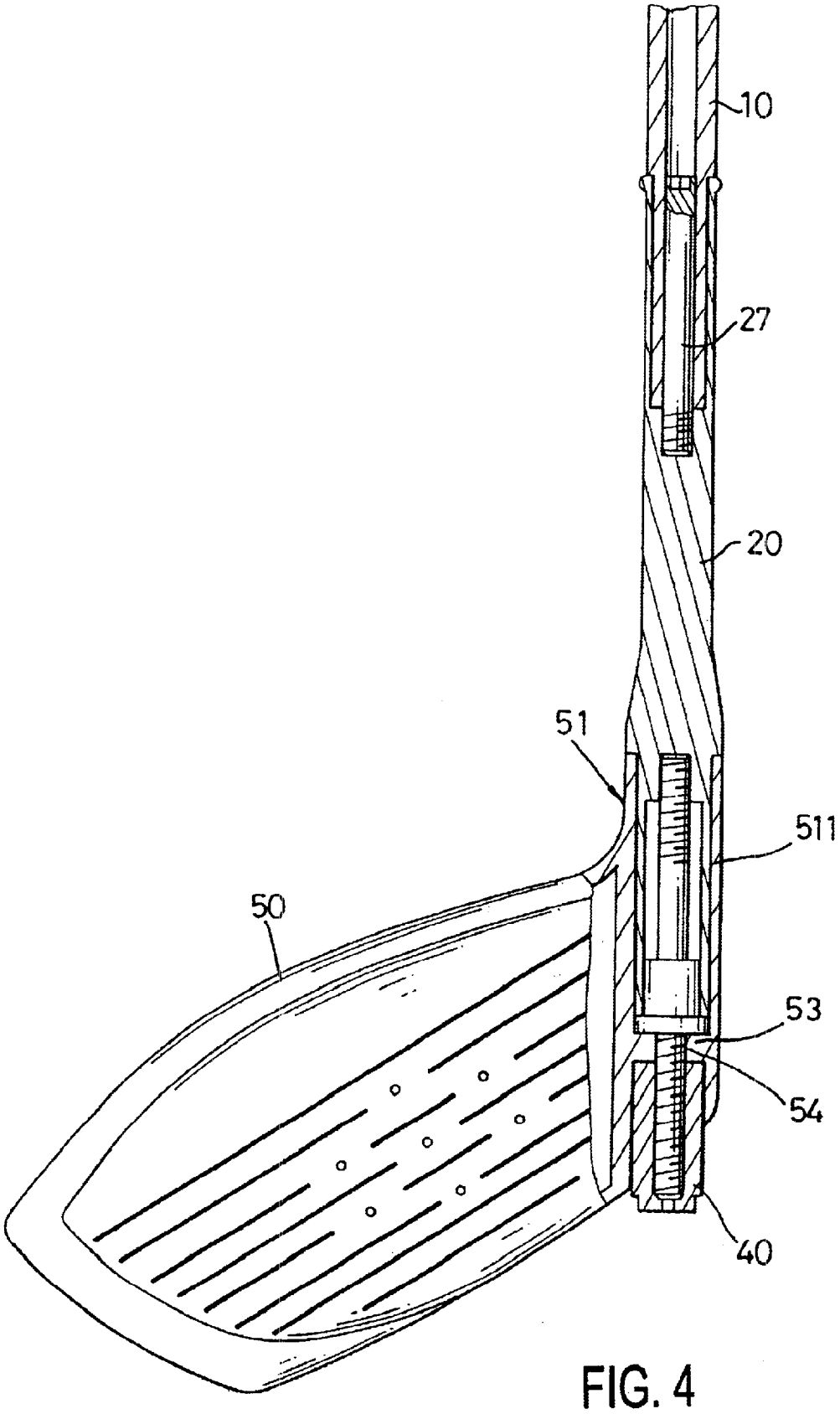
FIG. 4 is a cross sectional assembly view of the golf club in accordance with the invention.

With reference to FIGS. 2 to 4, the shaft (10) has a connecting portion (12) integrally formed at a lower end thereof, and a bore (13) defined in a center of the connecting portion (12). The head (50) has a striking face (52) formed at one end thereof, and a fixing seat (51) formed at one side of the striking face (52). The fixing seat (51) is defined with a fixing hole (511) in a center thereof. A fixing block (53) is formed in a middle position of the fixing hole (511). An aperture (54) is defined in a center of the fixing block (53).

The weight tube (20) is optionally made of materials with high density, for example, stainless steel. The weight tube (20) has a shoulder (21) integrally formed in a middle position thereof, a first end thereof defined with a first socket (23), and a second end thereof formed with a fixing tube (22) which is therein defined with a second socket (25). The connecting portion (12) is correspondingly fitted into the first socket (23) of the weight tube (20). A spindle (27) has a first end portion extended into the bore (13) of the shaft (10), and a second end portion extended into the first socket (23) and threadingly engaged into a first thread hole (24) defined in a bottom of the first socket (23). An adhesive material is applied between the spindle (27) and to the bore (13), and the connecting portion (12) to the first socket (23).

A connecting spindle (30) is preferably made of materials with low densities, such as PC or PBT etc., and has two opposite ends thereof respectively formed with two threads. A retaining ring (31) is integrally formed at a middle position of the connecting spindle (30). A joint portion (32) is integrally formed adjacent the retaining ring (31) and corresponds to the second socket (25) of the weight tube (20).

A first end of the connecting spindle (30) is extended into the second socket (25) and threadingly engaged into a second thread hole (26) defined in a bottom of the second socket (25). The joint portion (32) is correspondingly inserted into the second socket (25). The retaining ring (31) formed with a diameter substantially equal to an external diameter of the fixing tube (22) is retained by an end face of the fixing tube (22). The adhesive material is applied between the joint portion (32) and the second socket (25).

Then, the fixing tube (22) is correspondingly fitted into the fixing hole (511) of the king seat (51). A second end of the connecting spindle (30)is extended through the aperture (54) and threadingly engaged into a fastening member (40). The adhesive material is applied between the fixing tube (22) to the fixing hole (511), and the fastening member (40) to the fixing hole (511).

Since the weight tube (20) is equal to the weight of the standard head of the conventional golf club minus the weight of the head of the golf club of the invention, the weight of the whole golf club of the invention is equal to the weight of the conventional golf club, and the head (50) of the golf club of the invention has a weight less than the weight of the standard head of the conventional golf club. Because the twisting force caused by the weight of the head (50) is less than the twisting force caused by the weight of a standard head of a conventional golf club, the stability of the golf club is improved. However, the player still feels a same sense of gripping the golf club of the present invention, for the weight of the golf club is the same as the conventional golf club.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A golf club comprising a shaft wit a grip connected at an upper end thereof, with the shaft having a lower end;

a head, with a fixing seat fanned at one side of the head;

a weight tube having a first end defined with a first socket to receive the lower end of the shaft, with the weight tube having a second end formed with a fixing tube having a second socket defined in a center thereof, wit the fixing seat having a fixing hole defined in a center thereof to receive the fixing tube correspondingly fitted therein;

a connecting spindle having a first end thereof extended into the second socket and threadingly engaged into a thread hole defined in a bottom of the second socket, with the connecting spindle having a second end threadingly to secure said second end to the head;

a retaining ring integrally formed at a middle of the connecting spindle and formed with a diameter equal to an external diameter of the weight tube; and a joint portion formed adjacent the retaining ring to be correspondingly fitted into the second socket.

2. The golf club as claimed in claim 1, wherein the lower end of the shaft is formed with a connecting portion having a bore defined therein, with the first socket receiving the connecting portion correspondingly fitted therein, with the golf club further comprising a spindle having a first end portion extended into the bore of the shaft and a second end portion threadingly engaged into a thread hole defined in a bottom of the first socket.

3. The golf club as claimed in claim 2, wherein an adhesive material is applied between the spindle to the bore, and the connecting portion to the first socket.

4. The golf club as claimed in claim 3, wherein the weight tube has a shoulder formed in a middle thereof, with a fixing block being defined in a middle position of the fixing hole, and with an aperture being defined in a center of the fixing block, with the second end of the connecting spindle extended through the aperture and threadingly engaged into a fastener.

5. The golf club as claimed in claim 4, wherein the adhesive material is applied between the joint portion to the second socket, the fixing tube to the fixing hole, and the fastening member to the fixing hole.

* * * * *